US008252096B2

(12) United States Patent
Horne

(10) Patent No.: US 8,252,096 B2
(45) Date of Patent: Aug. 28, 2012

(54) CLEANING AND/OR FILTERING APPARATUS

(75) Inventor: Lucas Horne, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 667 days.

(21) Appl. No.: 12/303,921

(22) PCT Filed: Jun. 7, 2007

(86) PCT No.: PCT/GB2007/002081

§ 371 (c)(1),
(2), (4) Date: Aug. 19, 2009

(87) PCT Pub. No.: WO2007/141523

PCT Pub. Date: Dec. 13, 2007

(65) Prior Publication Data

US 2010/0236012 A1 Sep. 23, 2010

(30) Foreign Application Priority Data

Jun. 8, 2006 (GB) ..... 0611296.5
Nov. 3, 2006 (GB) ..... 0621935.6

(51) Int. Cl.
*B03C 3/15* (2006.01)

(52) U.S. Cl. ..... 96/55; 55/DIG. 3; 60/275; 60/311; 953/70; 953/78; 96/61

(58) Field of Classification Search ..... 96/55–57, 96/61; 55/318, 345, 459.1, DIG. 3, 385.3; 95/69, 70, 78; 60/275, 311
See application file for complete search history.

(56) References Cited

U.S. PATENT DOCUMENTS

| | | | | | |
|---|---|---|---|---|---|
| 2,081,772 | A | * | 5/1937 | Saint-Jacques | 95/63 |
| 2,569,710 | A | | 10/1951 | Fitzpatrick | |
| 2,711,226 | A | * | 6/1955 | Davis, Jr. | 96/61 |
| 3,526,081 | A | * | 9/1970 | Kusters | 96/61 |
| 4,010,011 | A | * | 3/1977 | Reif | 96/61 |
| 4,133,653 | A | | 1/1979 | Soltis | |
| 4,309,199 | A | | 1/1982 | Suzuki | |
| 4,352,681 | A | * | 10/1982 | Dietz | 96/61 |
| 4,370,155 | A | | 1/1983 | Armbruster | |
| 4,478,613 | A | * | 10/1984 | Brettschneider et al. | 96/61 |

(Continued)

FOREIGN PATENT DOCUMENTS

CA 714367 7/1965

(Continued)

OTHER PUBLICATIONS

Great Britain search report mailed on Oct. 9, 2007 directed at counterpart application international application PCT/GB2007/0022081; 3 pages.

(Continued)

*Primary Examiner* — Richard L Chiesa
(74) *Attorney, Agent, or Firm* — Morrison & Foerster LLP

(57) ABSTRACT

The invention relates to apparatus and a method for separating solid particles from fluids and particularly gas flows. The apparatus is particularly for use in conjunction with an internal combustion engine or vacuum cleaner. The apparatus includes a cyclone separator which has at least two axial common cyclone separator elements, an inner and outer element, in conjunction with a two-stage electrostatic precipitator. The apparatus allows the filtration of fluid effectively, even if the flow varies over time.

34 Claims, 8 Drawing Sheets

U.S. PATENT DOCUMENTS

| | | | | |
|---|---|---|---|---|
| 4,507,131 | A | 3/1985 | Fathauer et al. | |
| 4,541,847 | A | 9/1985 | Oie et al. | |
| 4,718,923 | A | 1/1988 | Haag et al. | |
| 4,726,825 | A | 2/1988 | Natale | |
| 4,826,515 | A | 5/1989 | Dyson | |
| 4,853,011 | A | 8/1989 | Dyson | |
| 4,973,341 | A * | 11/1990 | Richerson | 96/61 |
| 5,143,524 | A | 9/1992 | Inculet et al. | |
| 5,230,722 | A | 7/1993 | Yonkers | |
| 5,248,323 | A | 9/1993 | Stevenson | |
| 5,582,632 | A | 12/1996 | Nohr et al. | |
| 5,593,476 | A | 1/1997 | Coppom | |
| 5,647,890 | A | 7/1997 | Yamamoto | |
| 5,651,811 | A | 7/1997 | Frey et al. | |
| 5,683,494 | A * | 11/1997 | Altman et al. | 96/55 |
| 5,755,333 | A | 5/1998 | Stencel et al. | |
| 6,197,096 | B1 | 3/2001 | Cartellone | |
| 6,228,148 | B1 * | 5/2001 | Aaltonen et al. | 95/74 |
| 6,245,126 | B1 | 6/2001 | Feldman et al. | |
| 6,482,252 | B1 | 11/2002 | Conrad et al. | |
| 6,709,495 | B1 | 3/2004 | Storer | |
| 6,740,144 | B2 * | 5/2004 | Conrad et al. | 96/57 |
| 7,156,902 | B1 * | 1/2007 | Altman | 96/53 |
| 7,179,314 | B2 | 2/2007 | Conrad et al. | |
| 7,311,747 | B2 | 12/2007 | Adamek et al. | |
| 7,497,899 | B2 | 3/2009 | Han et al. | |
| 7,507,269 | B2 | 3/2009 | Murphy et al. | |
| 7,547,336 | B2 | 6/2009 | Fester et al. | |
| 7,556,662 | B2 | 7/2009 | Lee et al. | |
| 7,731,769 | B2 | 6/2010 | Min | |
| 2002/0134238 | A1 | 9/2002 | Conrad et al. | |
| 2003/0037676 | A1 | 2/2003 | Dunshee | |
| 2004/0065202 | A1 | 4/2004 | Gatchell et al. | |
| 2004/0194250 | A1 | 10/2004 | Conrad et al. | |
| 2005/0000361 | A1 * | 1/2005 | Chang et al. | 96/61 |
| 2005/0028675 | A1 | 2/2005 | Conrad et al. | |
| 2005/0050678 | A1 | 3/2005 | Oh et al. | |
| 2005/0087080 | A1 | 4/2005 | Yoshida et al. | |
| 2005/0091786 | A1 | 5/2005 | Wright et al. | |
| 2005/0125939 | A1 | 6/2005 | Hansen et al. | |
| 2005/0177974 | A1 | 8/2005 | Conrad et al. | |
| 2006/0123590 | A1 | 6/2006 | Fester et al. | |
| 2006/0168923 | A1 | 8/2006 | Lee et al. | |
| 2006/0278081 | A1 * | 12/2006 | Han et al. | 96/61 |
| 2007/0199449 | A1 | 8/2007 | Wiser et al. | |
| 2007/0199451 | A1 | 8/2007 | Wiser | |
| 2008/0250926 | A1 | 10/2008 | Riskin | |
| 2010/0212104 | A1 | 8/2010 | Conrad | |
| 2010/0242214 | A1 | 9/2010 | Sunderland et al. | |
| 2010/0242215 | A1 | 9/2010 | Dyson et al. | |
| 2010/0242216 | A1 | 9/2010 | MacNaughton | |
| 2010/0242217 | A1 | 9/2010 | Sunderland et al. | |
| 2010/0242218 | A1 | 9/2010 | Genn et al. | |
| 2010/0242219 | A1 | 9/2010 | Dyson et al. | |
| 2010/0242220 | A1 | 9/2010 | Dyson et al. | |
| 2010/0242221 | A1 | 9/2010 | Horne et al. | |
| 2011/0016659 | A1 | 1/2011 | Dyson et al. | |
| 2011/0016660 | A1 | 1/2011 | Horne | |
| 2011/0016661 | A1 | 1/2011 | Dyson et al. | |
| 2011/0016662 | A1 | 1/2011 | Horne | |
| 2011/0016663 | A1 | 1/2011 | Horne | |

FOREIGN PATENT DOCUMENTS

| | | |
|---|---|---|
| CN | 2548689 | 5/2003 |
| CN | 1751648 | 3/2006 |
| CN | 201179381 | 1/2009 |
| DE | 3804651 | 8/1989 |
| EP | 0 042 723 | 12/1981 |
| EP | 0 299 197 | 1/1989 |
| EP | 0 443 254 | 8/1991 |
| EP | 0 815 788 | 1/1998 |
| EP | 1 239 760 | 9/2002 |
| EP | 1 688 078 | 8/2006 |
| EP | 1 733 795 | 12/2006 |
| FR | 2 859 372 | 3/2005 |
| FR | 2 884 857 | 10/2006 |
| GB | 2033256 | 5/1980 |
| GB | 2 349 105 | 10/2000 |
| GB | 2 365 324 | 2/2002 |
| GB | 2 384 451 | 7/2003 |
| GB | 2 418 163 | 3/2006 |
| GB | 2 435 626 | 9/2007 |
| JP | 43-10791 | 5/1968 |
| JP | 55-101758 | 8/1980 |
| JP | 56-53771 | 5/1981 |
| JP | 61-29856 | 2/1986 |
| JP | 7-39479 | 2/1995 |
| JP | 2000-515810 | 11/2000 |
| JP | 2003-517862 | 6/2003 |
| JP | 2004-510452 | 4/2004 |
| JP | 2005-21469 | 1/2005 |
| JP | 2005-307831 | 11/2005 |
| JP | 2006-136766 | 6/2006 |
| JP | 2006-205162 | 8/2006 |
| JP | 2006-346429 | 12/2006 |
| JP | 2007-167632 | 7/2007 |
| JP | 2007-252577 | 10/2007 |
| JP | 2007-296305 | 11/2007 |
| JP | 2008-272474 | 11/2008 |
| JP | 2009-11869 | 1/2009 |
| WO | WO-02/069777 | 9/2002 |
| WO | WO-02/069778 | 9/2002 |
| WO | WO-02/078506 | 10/2002 |
| WO | WO-2008/135708 | 11/2008 |

OTHER PUBLICATIONS

International Search Report and Written Opinion directed to counterpart international application PCT/GB2007/002081 mailed on Oct. 9, 2007; 15 pages.

Horne, L. et al., U.S. Office Action mailed Aug. 2, 2011, directed to U.S. Appl. No. 12/749,137; 9 pages.

* cited by examiner

CLEANING AND/OR FILTERING APPARATUS

REFERENCE TO RELATED APPLICATIONS

This application is a national stage application under 35 USC 371 of International Application No. PCT/GB2007/002081, filed Jun. 7, 2007, which claims the priority of United Kingdom Application Nos. 0611296.5 and 0621935.6, filed Jun. 8, 2006, and Nov. 3, 2006, respectively, the contents of which prior applications are incorporated herein by reference.

FIELD OF THE INVENTION

The invention to which this application relates is to apparatus and a method for separating solid particles from fluids and particularly gas flows and in particular, although not necessarily exclusively, for use in conjunction with internal combustion engines or vacuum cleaners, to act as a means for filtering the said particles from an incoming air flow.

BACKGROUND OF THE INVENTION

A problem with apparatus of this type is that if the particles carried in the airflow are not effectively removed without a large energy loss across said apparatus, then the operation of the engine may be adversely affected and/or the operation of the vacuum cleaner is not sufficiently efficient.

SUMMARY OF THE INVENTION

An aim of the present invention is to provide a means whereby particles can be efficiently removed from a fluid flow thereby allowing the efficient removal of particles from the same and improving the operation of the apparatus with which the cleaning apparatus is used.

In a first aspect of the invention, there is provided apparatus to perform a cleaning action by removing particles from a fluid flowing through said apparatus, said apparatus comprising a cyclone separator means positioned substantially in the path of said fluid flow, said means having one or more inlets and fluid flow guide means, and at least one electrostatic precipitator means positioned substantially in said flow and wherein said cyclone separator means includes at least two axial flow cyclone separator elements provided in a concentric configuration along a common axis.

In one embodiment each cyclone element in order from the outer separator element has an increased separation efficiency so as to allow successively smaller sizes of particles to be removed from the fluid flow.

In one embodiment the inlets are provided tangentially to the fluid flow to guide the fluid in a desired path into the cyclone separator means.

In one embodiment, a multistage electrostatic precipitator is provided, typically a two stage precipitator.

In one embodiment, the apparatus is provided in conjunction with an internal combustion engine and the fluid flow with which the system is utilised, is an air flow passing towards the internal combustion engine to aid the operation of the engine.

In an alternative embodiment the cleaning apparatus is provided in conjunction with a vacuum cleaner.

In one embodiment, the apparatus includes a collection means such as a hopper in which particles which are removed from the fluid flow by the apparatus, can be collected and discarded as required.

In one embodiment, the apparatus includes an inlet duct, which duct directs the fluid flow and also houses a voltage emitter rail.

Typically, a negative voltage is applied to the emitter rail to provide particles in the fluid flow with a negative voltage and at least one plate of the electrostatic precipitator is positively charged so as to attract the negatively charged particles to the same and allow the same to be collected for subsequent disposal.

Typically, one or more plates in the precipitator, are provided with a negative charge so as to cause the negatively charged particles, to be accelerated from those relatively charged plates towards the at least one positively charged plate in the precipitator.

Typically, a plurality of the negative and positively charged plates are interspersed alternately such that adjacent plates in the precipitator, have opposing charges.

Typically, the cyclone separator means is positioned intermediate the emitter rail and in advance of the electrostatic plates with respect to the fluid flow such that the fluid flow passes through the cyclone separator prior to reaching the electrostatic plates.

In an alternative embodiment the precipitator is located upstream of the cyclone separator means.

Typically, the cyclone separator means induces a circular fluid flow as the fluid passes to the electrostatic plates and, furthermore, the rotational flow which is created by the cyclonic separator, causes particles of a certain size or greater in the fluid to be thrown against the external surfaces of the cyclonic separator, allowing those particles to be removed from the fluid flow. This allows the cyclonic separator to act as a first stage filter to allow larger particles to be removed from the fluid flow prior to the fluid reaching the electrostatic plates. This serves to improve the efficiency of the removal of particles from the fluid flow.

Preferably the cyclone separator means is located such that the airflow is relatively high and the precipitator means is located where the airflow is relatively low.

In one embodiment the precipitator includes a plurality of plates which are mounted on the outer surface of the outer cyclone separator element.

In a further aspect of the invention there is provided a fluid flow to an internal combustion engine, said fluid flow passing through apparatus including a cyclone separator means and an electrostatic precipitator means positioned substantially in the flow of said fluid and wherein the cyclone separator means includes at least two concentrically mounted cyclone separator elements.

Typically the cyclone separator elements are mounted on a common axis.

In either of the above embodiments of apparatus, the use of the electrostatic precipitator and/or axial cyclone separator, allows the removal of particles from the fluid flow and hence prevents the said particles from reaching the internal combustion engine and it is found that the use of the axial cyclone separator and subsequently the electrostatic precipitator allows improved and efficient filtering of the particles from the fluid.

In a yet further aspect of the invention, there is provided apparatus to remove particles from the flow of fluid entering a vacuum cleaner, said apparatus including a cyclone separator means and precipitator unit wherein, said cyclone separator means includes at least two concentric axial flow cyclone separator elements arranged from the outer element in order of increasing efficiency.

In one embodiment, the axial cyclone separator is selected so as to allow particles of a larger size to be removed from the fluid flow prior to the fluid reaching the electrostatic precipitator and the control of the precipitator is selected so as to allow particles of a selected size to be removed from the fluid flow.

In a yet further aspect of the invention there is provided cleaning apparatus including a cyclone separator and an electrostatic precipitator wherein the precipitator includes a plurality of plates which are mounted on the outer surface of the outer cyclone separator element.

This assembly serves to attract particles to the plates, especially those smaller particles which would not be thrown to the wall of the outer cyclone and hence allows these smaller particles to also be removed from the fluid flow.

Typically the precipitator plates collect particles through electrostatic attraction and mechanical impaction; and is required as, on occasion, the swirl induced airflow which throws the majority of particles to the outer cyclone wall cannot separate the smallest particles. Thus, in accordance with the invention the particles which circulate the plates and do not follow the same path as particles of a greater mass are efficiently removed from the airflow through impaction on the plates and electrostatic attraction to them.

Thus, this assembly can be used to advantage in any form of cyclone separator whether it includes one or a plurality of cyclone separator elements.

This particularly advantageous aspect of the design serves to effectively remove small particulates, whereas in prior art devices there is no means possible to separate particles which are not thrown to the outer wall of the cyclone.

Typically, in whichever embodiment the cyclone separator means is positioned in a relatively high airflow speed and the precipitator means is positioned in a relatively lower airflow speed.

BRIEF DESCRIPTION OF THE DRAWINGS

Specific embodiments of the invention are now described with respect to the accompanying Figures wherein.

DETAILED DESCRIPTION OF THE INVENTION

Figure 1A:
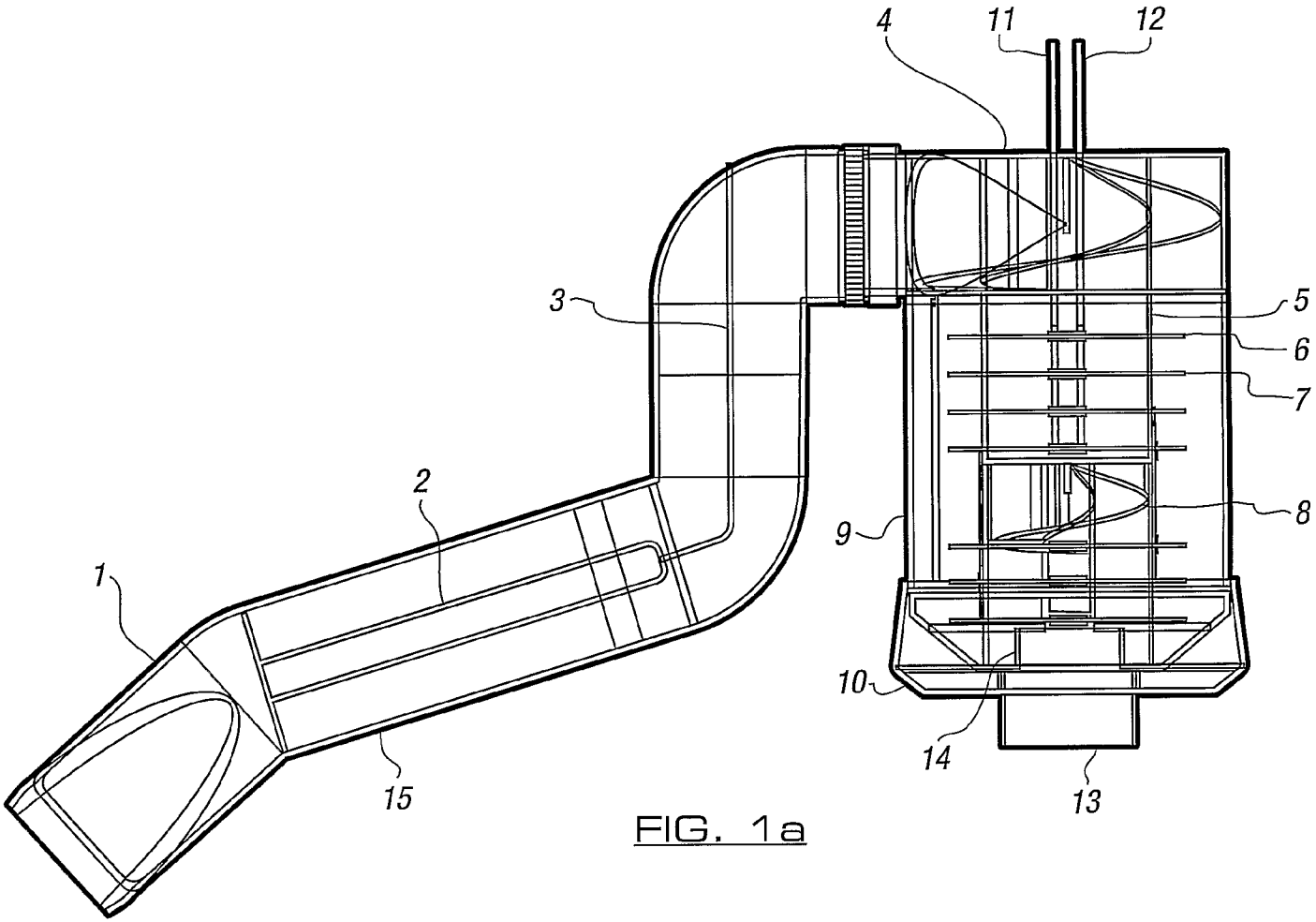
FIG. 1*a* shows a detailed view of the apparatus in one embodiment.
Figure 1B:
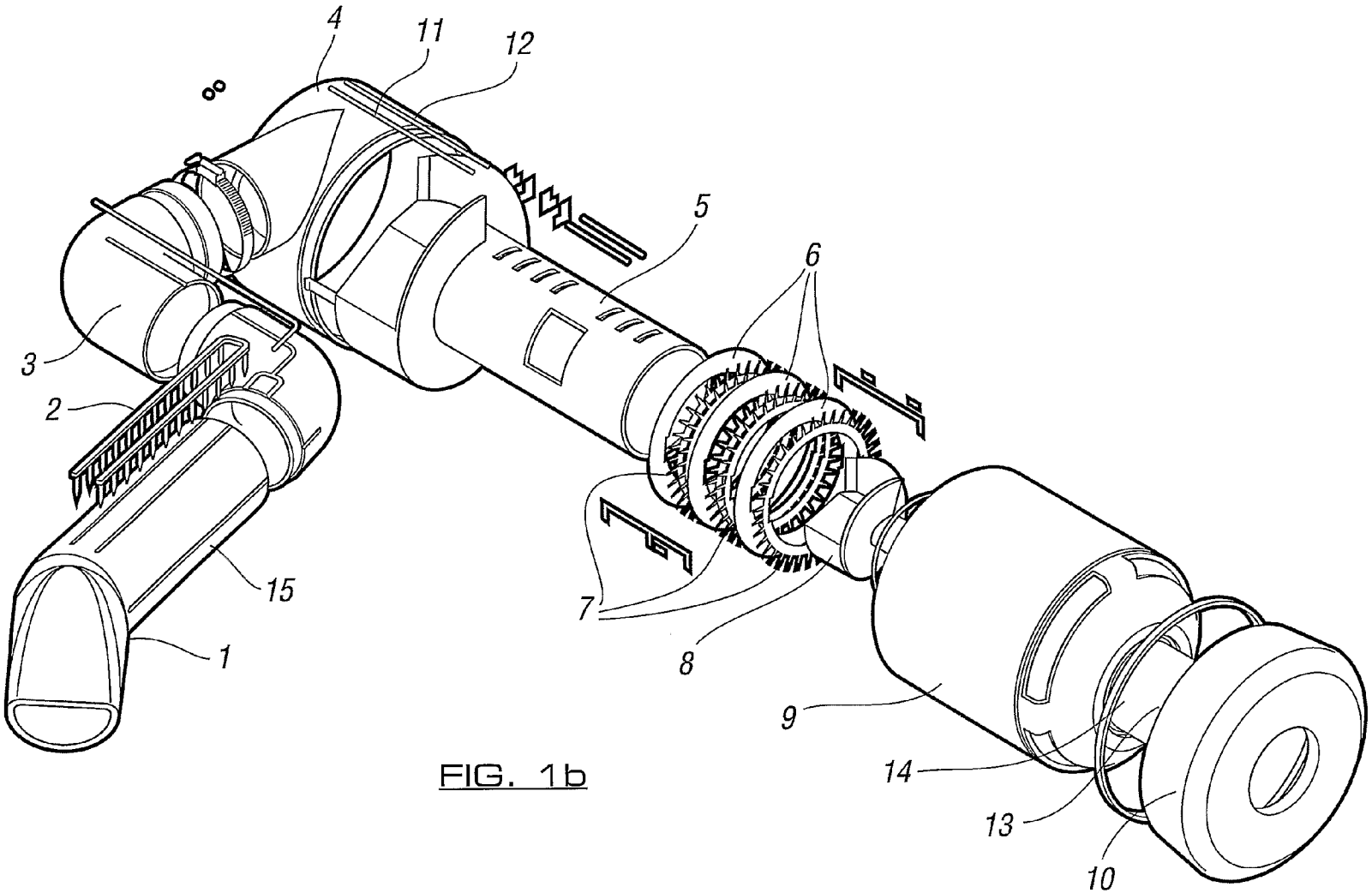
FIG. 1*b* shows an exploded view of the components of the apparatus in accordance with FIG. 1*a;*

As shown in FIGS. 1*a* and *b*, the apparatus in accordance with the invention provides an electro-inertial cleaning apparatus and the apparatus, in this embodiment, comprises an inlet tract 1 which extends from the main body of the system 4 and 9. The apparatus can be positioned at the front, in this case of a vehicle, so as to receive a cooling air flow which is denser and has a higher oxygen content resulting in more efficient combustion when supplied to the internal combustion engine within the vehicle. Thus airflow does however have to be provided in a relatively "clean" form to the engine to therefore provide the benefits when the airflow reaches the engine (not known) downstream of the cleaning apparatus.

The inlet tract's other purpose is to provide a mount for a high voltage emitter rail 2. The inlet tract may take any shape or form of that is required to receive the airflow.

A removable hopper 10 enables particles which are removed from the airflow by the apparatus to be emptied at relevant service intervals or when full.

The construction of the inlet tract 1 and inlet part 4 and main body 9 can be from a polymer with a high deflection temperature to keep the air within the system cool and withstand heat from the engine bay.

Figure 2:
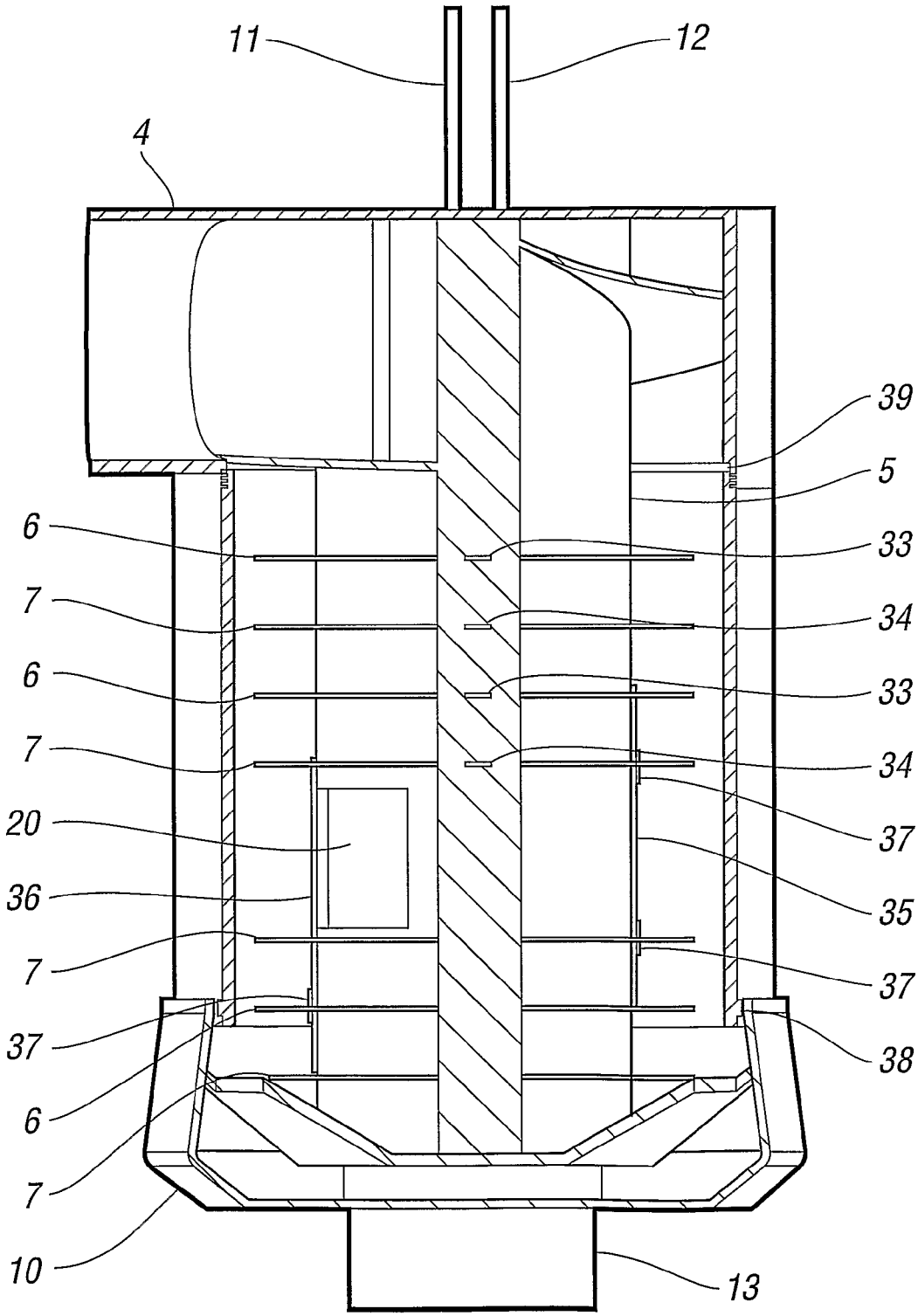
FIG. 2 shows a sectional view of the apparatus with an inlet pipe removed.
Figure 10:
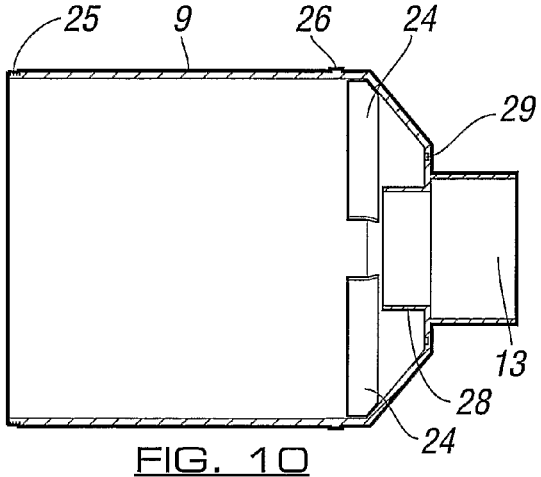
FIG. 10 shows a cut through view of the outer casing; of the cyclone separator.

The inlet 4 connects to 9 via a screw thread connection. FIG. 10 and feature 25 shows the thread. This eliminates any fasteners required, reducing assemble times and components costs, and allows fast disassemble for any cleaning of the system that may be required. A rubber seal 39 locates between inlet 4 and main body 9 as shown in FIG. 2 forming an airtight seal.

The initial ionisation of the particles occurs in inlet 4 where a negative voltage is applied to the emitter rail 2 through the wire 3. Particles which are sufficiently charged with a negative voltage collect on positively charged plates 6, of the multistage electrostatic precipitator. Plates 7 are negatively charged creating an electrostatic field repelling particles towards the positive plates. The spacing of the plates is sufficient so as to avoid arcing and are insulated by a cyclone guide element 5 on which they are mounted. The plates are connected to the respective positive and negative high voltage supplies through the two wires 11 and 12 which run through the centre of guide 5.

Figure 5:
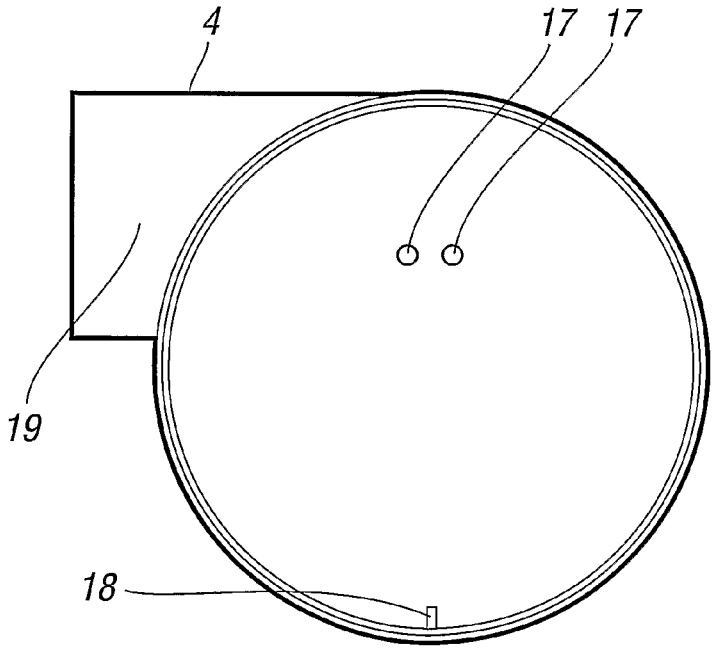
FIG. 5 shows a plan view of the inlet of the apparatus.

As shown in FIG. 5 holes 17 allow the wires to extend to a high voltage supply. So as to reduce the number of wires, connection rails 35 and 36 provide voltage from the plates below the entrance 20 to those above it as shown in FIG. 2. Rubber insulators 37 prevent arcing between the plates.

Figure 12:
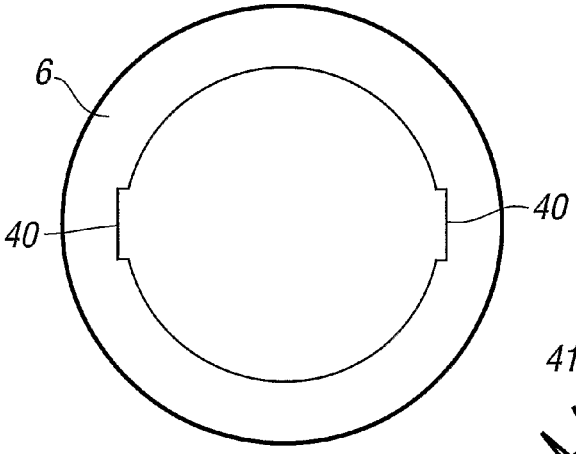
FIG. 12 shows a plan view of a particle collecting plate.
Figure 13:
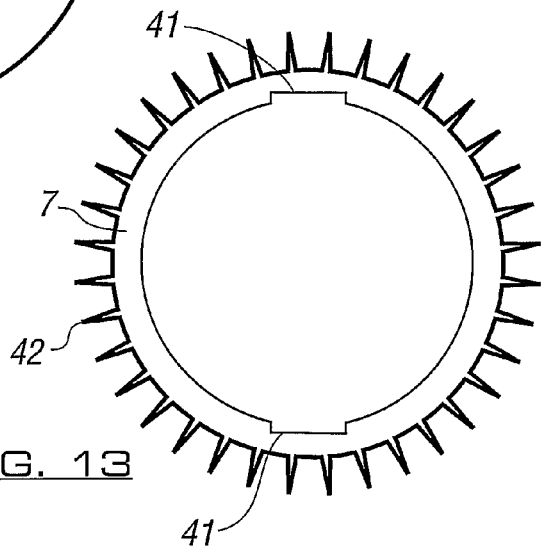
FIG. 13 shows a plan view of an emitter plate.

As shown in FIGS. 12 and 13 features 40 and 41 allow the plates to be assembled on 5. They lock in place by turning to locate on protrusions 21. FIG. 13 shows the spiked shape of negative plate 7. This is to increase corona discharge from the plates and allows further ionisation of particulates to aid collection efficiency. The plates 6 and 7 are ideally constructed from a non-corrosive metal such as stainless steel.

The efficiency of the electrostatic precipitator and the plate's collection decreases as the airflow increases, therefore more effective collection is expected when the residence time of particulates in the system is sufficient for them to initially gain a negative charge and then collect on the positive plates. The two stage electrostatic precipitator is effective at collecting particles at voltages in order of 10,000 volts D.C.

To prevent particulate build up on the plates and potential re-entrant of particles the high voltage supply is integrated into the vehicle engine control unit (ECU). The circuit turns off when the airflow is sufficiently high to allow the particles to be purged through the two axial cyclone separators. As the particles lose their charge due to the circuit turning off, the airflow cleans the plates preventing caking and other undesirable affects.

Figure 3:
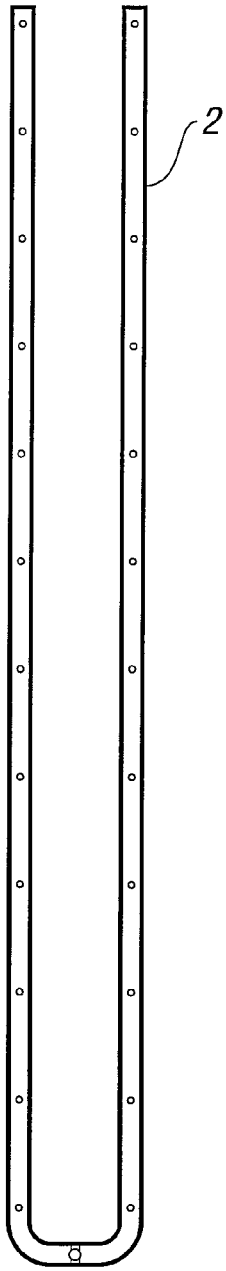
FIG. 3 shows a plan view of an emitter rail of the apparatus.
Figure 4:
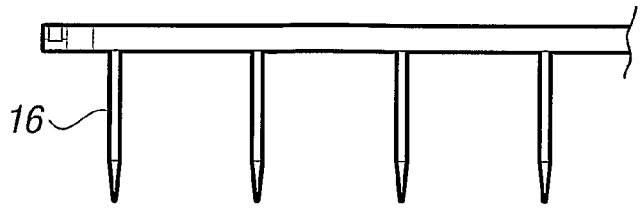
FIG. 4 shows a side view of the emitter rail of FIG. 3.

The emitter rail shown in FIGS. 3 and 4 is composed of a single piece construction and entails many emitter points so as to maximise corona discharge from these points. The material is preferably a non-corrosive metal such as stainless steel. The plastic construction of the inlet tract 2 insulates the emitter rail and the emitter rail cover 15 prevents accidental contact being made. The high voltage wire 3 connects the emitter rail to a negative DC high voltage.

Figure 6:
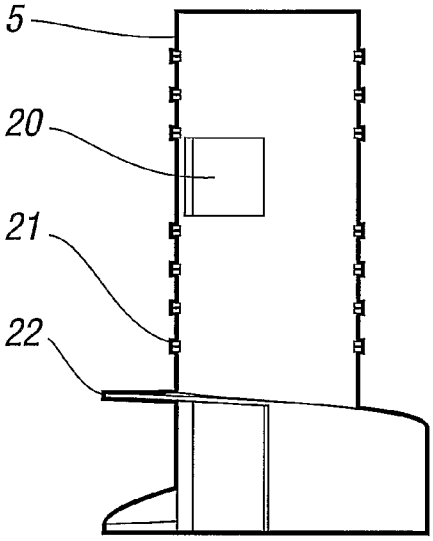
FIG. 6 shows a plan view of a cyclone guide element in accordance with one embodiment of the invention.
Figure 7:
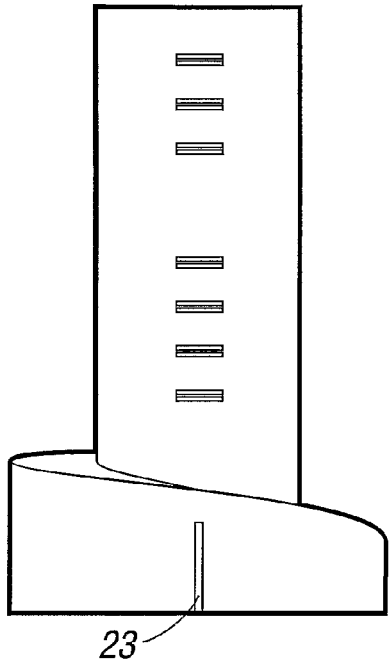
FIG. 7 shows a side view of the cyclone guide element of FIG. 6.

The inlet 4 consists, in accordance with one embodiment of the invention, of a tangential protrusion that introduces air to a cyclone separator element 5 as shown in FIGS. 6 and 7. FIGS. 6 and 7 show the shape of the helical guide element 22 that induces a swirl on the gas flow. This is the first stage of separation and larger particulates which are subject to centrifugal forces are thrown to the walls of main body 9 and exit through the large slits 24 as shown in FIG. 10. This serves to eject larger particulates prior to entry to the smaller inner cyclone, preventing fouling and adverse operation of the inner cyclone.

The particulates collect in the hopper 10 which fits over the main body 9 and is sealed by an interference fit between rubber seal 38 as shown in FIG. 2. The cyclone guide element 5 incorporates a location slit 23 that locates on 18 as shown in FIG. 5 ensuring correct assembly. FIG. 10 shows a location slot 29 which the end of 5 secures in.

The flowing gas has to pass through entrance 20 as shown in FIG. 2 so as to exit through 13. This is the entrance to the second axial cyclone separator element and its purpose is to separate small particulates in the order of 10 microns at high airflows when electrostatic collection would be low. The entrance 20 is protected by negatively charged plates 7 which repel any particulates. The entrance is positioned sufficiently far enough from the inlet so particles have time to collect on the plates, thus reducing the amount of particulates that may enter the inner cyclone.

Figure 8:
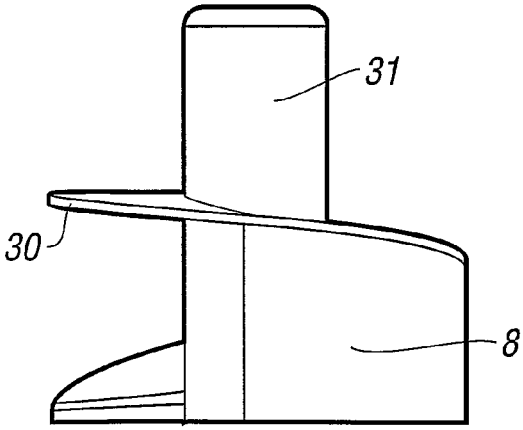
FIG. 8 shows a plan view of an inner cyclone guide element.
Figure 9:
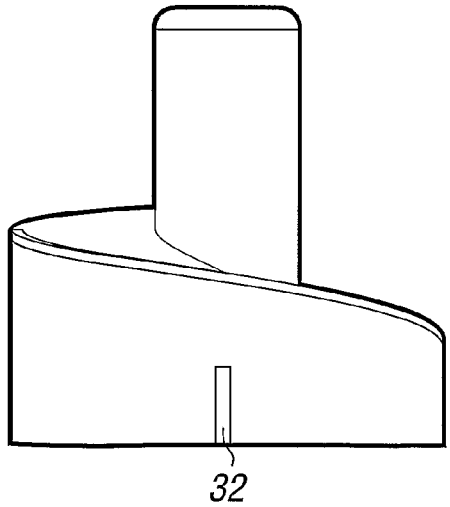
FIG. 9 shows a side view of the inner cyclone guide element.

FIGS. 8 and 9 show the second cyclone guide element 51 that fits inside 5 and ensures a swirling flow is induced upon the gas due to the curved helical feature 30. Feature 32 locates within 5 ensuring correct assembly.

Figure 11:
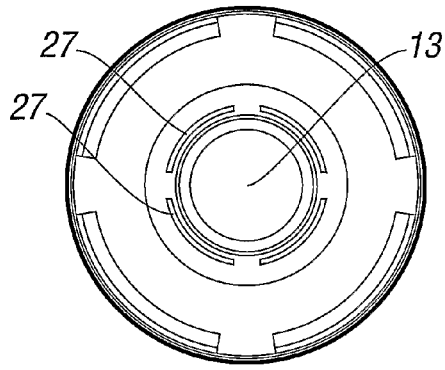
FIG. 11 shows a plan view of the casing of FIG. 10.

The protrusion 31 stabilises the vortex generated and ensures that it does not break down before particulates have been purged. Particles which are subject to centrifugal forces and are thrown to the inner wall of 5 and exit through slits 27 as shown in FIG. 11. FIG. 10 shows the protrusion 28 that extends within 9 to extract the clean gas flow. The hopper 10 is tapered to allow particles which are purged to descend without re-entrant occurring.

The two axial cyclone separator elements enable small particles to be purged at high airflows and the use of no swirl vanes ensures that clogging of the system never occurs.

To further reduce the pressure drop through the system pressure recovery vanes may be incorporated into the exit 13 to convert the swirling flow back into a laminar flow. This is an optional component and depends on the intended application of the system.

The size of the system and ratio of cyclone guide separator element 5 to body 9 may change to accommodate different engine requirements. Similarly the inlet 4 and outlet sizes 13 may also vary.

It should be appreciated that the use of the electrostatic precipitator and axial flow cyclonic separator means, in combination with the separator elements mounted concentrically along a common axis in order of increasing efficiency means that small particles can be effectively removed from the gas flow with a relatively low energy consumption. These advantages mean that the need for filter media to be used in engine applications is removed, or if filter media is still used in conjunction with the apparatus in accordance with the invention the life of the filter media is greatly extended without excessive energy consumption.

Figure 14:
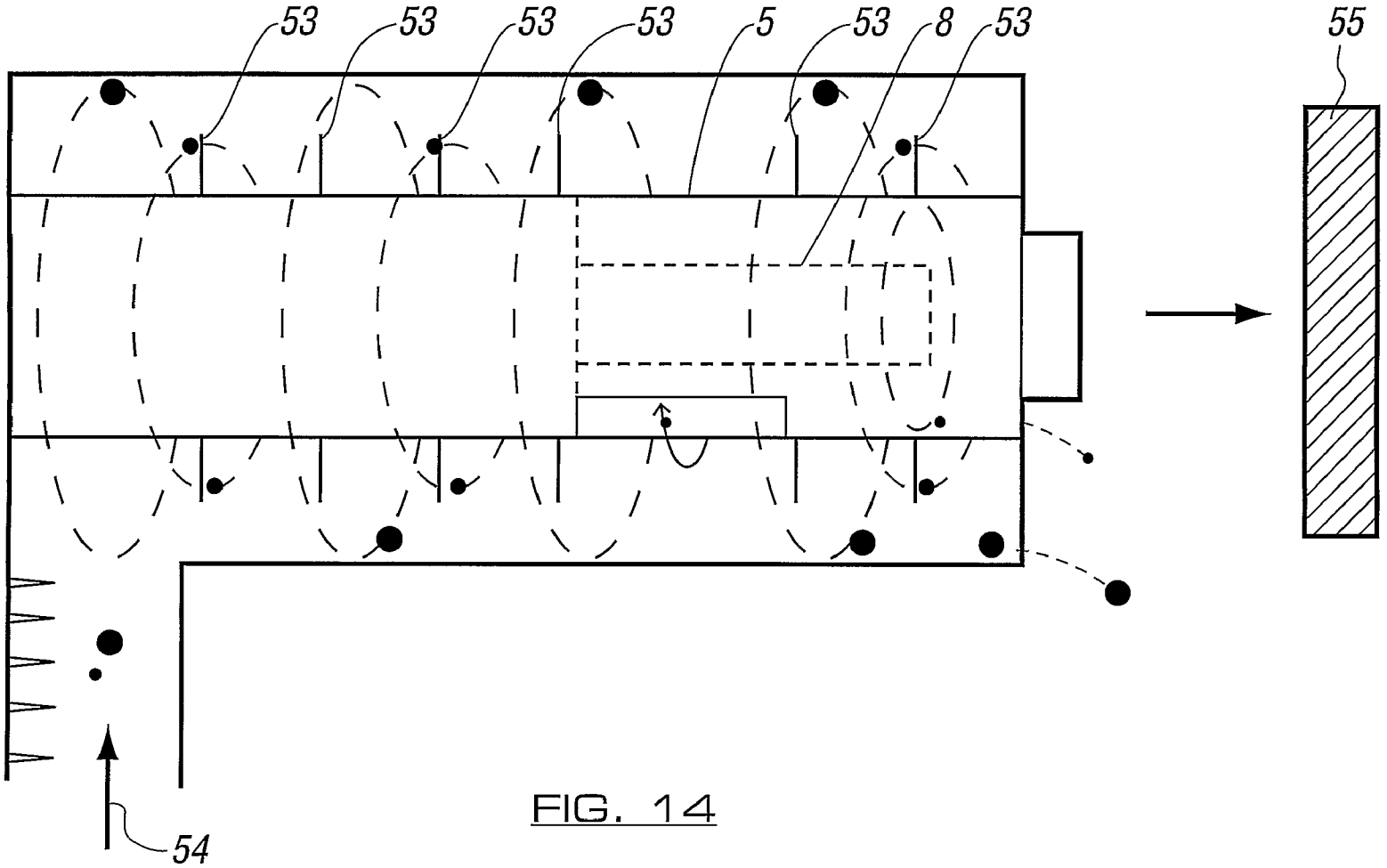
FIG. 14 shows an arrangement in a schematic manner in accordance with one embodiment of the invention.
Figure 15:
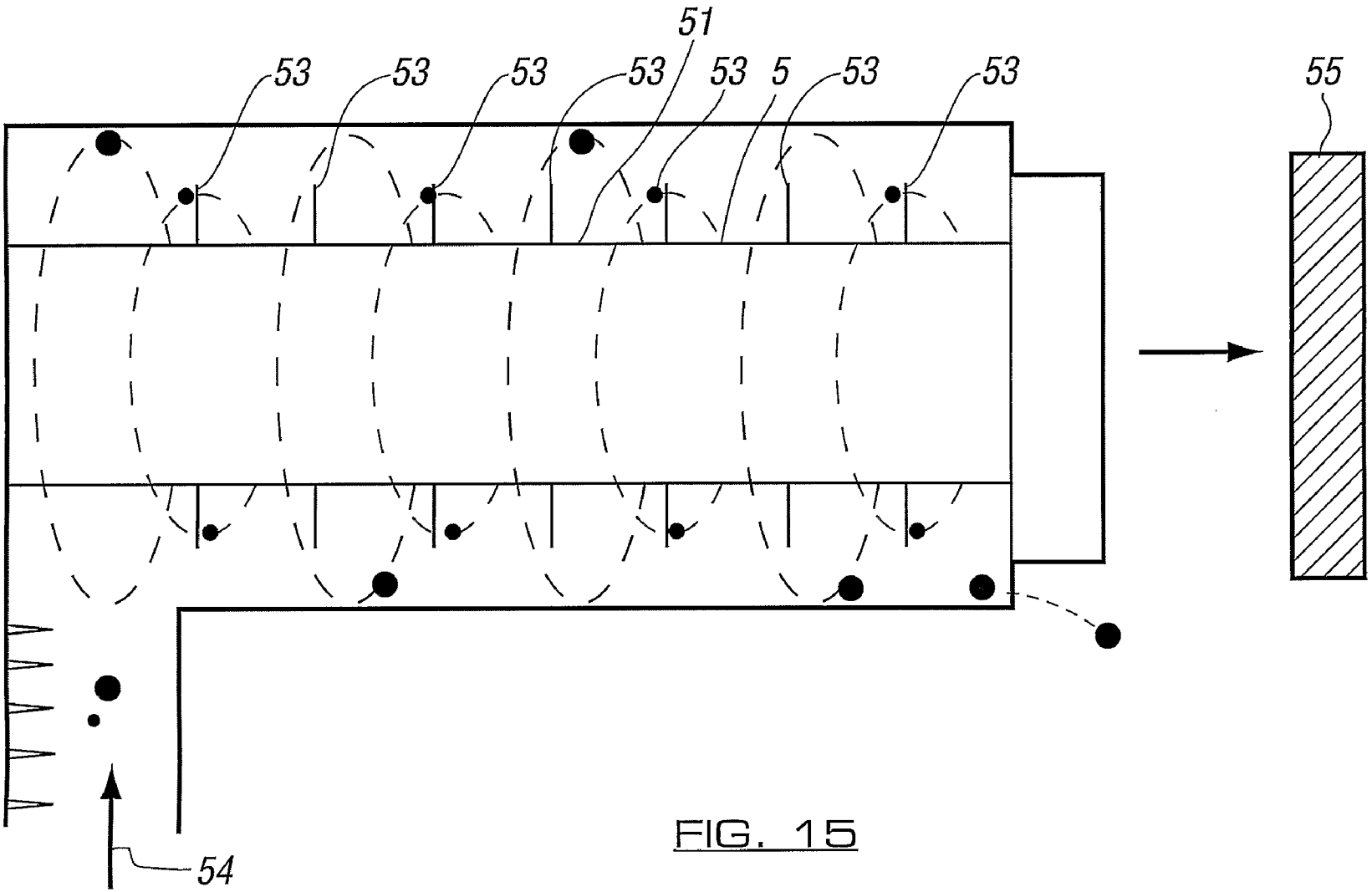
FIG. 15 shows an arrangement in a schematic manner in accordance with a further embodiment of the invention.

Referring now to FIGS. 14 and 15 there is illustrated the manner in which particles Z and Y in gas flow 54 can be separated from the flow as it passes the electrostatic precipitator plates 53 mounted on the external face 51 of the cyclone separator element 5. In FIG. 15 one cyclone separator element 5 is provided whereas in FIG. 14 two commonly axially mounted separator elements 5, 8 are provided.

It is illustrated how the larger particles Z are separated from the gas by the flow induced by the cyclone separator element 5. The smaller particles Y are separated from the gas flow by attraction to the electrostatic plates 53 and impaction onto the same. The apparatus may also be used with suction means to allow an airflow to be created through the cleaning apparatus which could be, for example an engine motor or fan. The apparatus may also include further cleaning media 55 as required.

The arrangement of FIGS. 14 and 15 may in one aspect of the invention be provided with a single or multiple cyclone separator elements. The outer surface 51 of the outer cyclone guide element 5 is used to mount one or more plates of the electrostatic precipitator which are provided with a charge which is such so as to cause particles which are within the fluid flow which passes the plates, to be attracted to the plates. This therefore allows particles, and particularly smaller particles, to be collected on the plates and hence removed from the fluid flow without the use of the cyclone separating means to do so. This is found to be of a particular advantage with regard to small particles, as it has been found that on occasion, the small particles may not be effectively removed by the cyclone separator means.

Thus, in combination, the use of both the electrostatic precipitator and the cyclone separating means, allow small and larger particles to be removed from the fluid flow using the respective apparatus. The provision of the plates on the external surface of the outer cyclone guide element is found to be particularly effective in removing the smaller particles from the fluid flow.

The invention claimed is:

1. An apparatus for performing a cleaning action by removing particles from a fluid flowing through said apparatus, comprising a cyclone separator positioned substantially in the path of said fluid flow, said cyclone separator having one or more inlets and fluid flow guides, and at least one electrostatic precipitator positioned substantially in said flow, said cyclone separator including at least two axial flow cyclone separator elements provided in a concentric configuration along a common axis, wherein a cyclone separator element is provided between the two axial flow cyclone separator elements.

2. The apparatus of claim 1, wherein the cyclone separator elements are arranged inside each other in order of increasing separation efficiency from the outer to the inner cyclone separator element.

3. The apparatus of claim 1, wherein an inlet to a first inner cyclone separator element is positioned substantially offset from an inlet to a first outer cyclone separator element.

4. The apparatus of claim 1, further comprising a conduit providing an airflow to an internal combustion engine.

5. The apparatus of claim 1, wherein the precipitator has at least two emitter points to increase corona discharge.

6. The apparatus of claim 5, wherein one stage of the electrostatic precipitator is at least one emitter rail.

7. The apparatus of claim 6, wherein the at least one emitter rail is negatively charged.

8. The apparatus of claim 1, wherein the apparatus includes at least one inlet duct which directs fluid flow into said apparatus.

9. The apparatus of claim 8, wherein at least one emitter rail is housed within at least one inlet duct and provides particles flowing therein with a negative charge.

10. The apparatus of claim 4, wherein a stage of the electrostatic precipitator comprises one or more plates.

11. The apparatus of claim 10, wherein at least one of the plates is positively charged.

12. The apparatus of claim 11, wherein at least one of the plates is negatively charged so as to cause negatively charged particles within the flow to be repelled towards the at least one positively charged plate.

13. The apparatus of claim 12, comprising at least two negatively and positively charged plates, said plates being interspersed alternatively such that adjacent plates have opposite charges.

14. The apparatus of claim 10, wherein the plates are mounted on an outer surface of the outer cyclone separator element.

15. The apparatus of claim 1, wherein the cyclone separator is located intermediate first and second stages of the electrostatic precipitator.

16. The apparatus of claim 1, wherein one or more of the cyclone separator elements are configured to induce a helical fluid flow to the fluid flowing in the apparatus, a subsequently induced centrifugal force causing at least a portion of particles contained in said fluid to impact against a wall enclosing the cyclone separator, thereby removing a portion of said particles from the fluid flow.

17. The apparatus of claim 16, wherein each cyclone separator element has a wall and at least one cyclone guide to induce and maintain the cyclonic motion of the fluid therein.

18. The apparatus of claim 15, wherein at least part of the fluid flow generated by the cyclone separator sweeps over the second stage of the electrostatic precipitator.

19. The apparatus of claim 1, configured to turn off the precipitator for a period of time, thereby removing any charge associated with plates of the precipitator.

20. The apparatus of claim 19, wherein the current supplied to the plates is turned off when the velocity of the fluid flow reaches a certain level.

21. The apparatus of claim 17, wherein plates of the precipitator are mounted on a cyclone separator element.

22. The apparatus of claim 21, further comprising wires supplying current to the plates located within a first cyclone guide.

23. The apparatus of claim 22, wherein the first cyclone guide comprises an insulated connection rail to prevent arcing between oppositely charged plates.

24. The apparatus of claim 1, wherein the precipitator is located between a first cyclone separator element and a second cyclone separator element.

25. The apparatus of claim 24, wherein the plates of a second stage of the electrostatic precipitator extend axially from a first outer cyclone guide on the plates of the second stage, said plates extending both inwardly and outwardly to be in contact with the fluid flowing through the first or second cyclone separator element.

26. The apparatus of claim 25, wherein the cyclone precipitator plates are substantially annular in shape.

27. The apparatus of claim 1, further comprising a hopper for collection of particles removed from the fluid flow.

28. The apparatus of claim 27, wherein the hopper is tapered to prevent the particles removed from the fluid flow from re-entering the fluid flow.

29. The apparatus of claim 1, wherein at least one of the inlets or one of the cyclone separator elements are constructed from one or more polymers with a sufficiently high deflection temperature to keep the fluid within the apparatus cool.

30. The apparatus of claim 1, wherein the cyclone separator is positioned in a relatively high airflow speed and the precipitator is positioned in a relatively lower airflow speed.

31. A vacuum cleaner comprising the apparatus of claim 1.

32. An apparatus for removing particles from the flow of fluid entering an internal combustion engine, said apparatus including a cyclone separator and a two stage electrostatic precipitator, both the separator and the electrostatic precipitator being positioned substantially in a path of said flow of fluid, the cyclone separator comprising at least two concentrically mounted axial cyclone separator elements, wherein a cyclone separator element is provided between the two axial flow cyclone separator elements.

33. The apparatus of claim 32, wherein said cyclone separator elements are in fluid communication.

34. The apparatus of claim 32, wherein the cyclone separator elements are positioned inside each other in order of increasing separation efficiency.

* * * * *